US005094394A

United States Patent [19]

Saukkonen

[11] Patent Number: 5,094,394

[45] Date of Patent: * Mar. 10, 1992

[54] METHOD AND DEVICE FOR THREADING THE END OF A WEB

[75] Inventor: Seppo Saukkonen, Vantaa, Finland

[73] Assignee: Valmet Paper Machinery Inc., Helsinki, Finland

[ * ] Notice: The portion of the term of this patent subsequent to May 21, 2008 has been disclaimed.

[21] Appl. No.: 567,005

[22] Filed: Aug. 13, 1990

Related U.S. Application Data

[63] Continuation-in-part of Ser. No. 526,547, May 17, 1990, Pat. No. 5,016,831, which is a continuation of Ser. No. 398,327, Aug. 23, 1989, abandoned, which is a continuation of Ser. No. 194,470, May 16, 1988, abandoned.

[30] Foreign Application Priority Data

May 20, 1987 [FI] Finland ..... 872222

[51] Int. Cl.[5] ..... B65H 19/28; B65H 20/16

[52] U.S. Cl. ..... 242/55; 226/92; 242/56 R

[58] Field of Search ..... 242/55, 56 R, 56 A, 242/56 B, 65, 66, 56.2, 56.4, 56.6, 76, 195; 226/91, 92

[56] References Cited

U.S. PATENT DOCUMENTS

| | | | |
|---|---|---|---|
| 2,277,319 | 3/1942 | Greenberger | 226/92 |
| 2,944,345 | 7/1960 | Faeber | 226/92 |
| 3,624,875 | 12/1971 | Haft | 226/92 X |
| 3,995,553 | 12/1976 | Winterholler et al. | 226/92 X |
| 4,161,269 | 7/1979 | Kirkpatrick | 226/92 |
| 4,444,360 | 4/1984 | Kaipf et al. | 242/56 R |
| 4,491,503 | 1/1985 | Adams et al. | 226/92 X |
| 4,637,566 | 1/1987 | Kyytsonen | 242/56 R |
| 5,016,831 | 5/1991 | Saukkonen | 242/55 |

*Primary Examiner*—Stanley N. Gilreath
*Attorney, Agent, or Firm*—Dellett, Smith-Hill and Bedell

[57] ABSTRACT

A method and a device for threading the end of a web (P) from a jumbo roll (30) or equivalent through a winder along a path determined by members guiding the web (P). The end of the web (P) is passed from the jumbo roll (30) through the winder as a full width by grasping the end of the web (P) placed on the jumbo roll by means of a fetching and grasping device (13) and is held by means of the web (P) holding device (13). The web (P) is detached from the fetching and grasping device (11), attached to a threading member (22) carried by a carrier device (12), detached from the web (P) holding device (13), and threaded as a single thickness through the winder, whereby web (P) is unwound from the jumbo roll (30). The web (P) is cut off before the web (P) is attached to the threading member (22) carried by the carrier device (12).

21 Claims, 4 Drawing Sheets

METHOD AND DEVICE FOR THREADING THE END OF A WEB

CROSS-REFERENCE TO RELATED APPLICATIONS

This is a continuation-in-part of co-pending application Ser. No. 07/526,547 filed May 17, 1990, now U.S. Pat. No. 5,016,831 which was filed as a continuation of co-pending application Ser. No. 07/398,327 filed Aug. 23, 1989, now abandoned, which was filed as a continuation of co-pending application Ser. No. 07/194,470 filed May 16, 1988, now abandoned.

BACKGROUND OF THE INVENTION

This invention relates to a method and apparatus for threading the end of a web from a jumbo roll or equivalent through a winder along a path determined by members guiding the web.

At present, the threading of the end of a web through a winder is carried out by tearing the end of the web to a wedge-shaped form and leading the end of the web through the winder, e.g. a carrier-drum slitter-winder, onto the carrier drums by means of a threading device. Thereupon the wedge-shaped end of the web is removed, and the slit component webs are wound around paper cores in known manner before the winding is started. It is a drawback of this method that the threading of the web is very slow and, as a rule, requires two or three workers, because the end of the web must first be torn to a wedge-shaped form, the creeping of the winder is slow, and the removal of the wedge-shaped end takes time. Moreover, the prior art method requires air blowers, belts, etc. as auxiliary equipment for the threading of the web.

In Finnish Patent No. 69,439, a method and device are described for threading the end of a web from a jumbo roll or equivalent through a winder along a path determined by the members guiding the web. In this prior art solution, the end of the web is passed from the jumbo roll through the winder at full width by grasping the end of the web placed on the jumbo roll and winding the web around a fetching and grasping device for a desired number of revolutions, whereupon the web is passed through the winder in doubled-over fashion so that the web is unwound at the same time both from the jumbo roll and from the fetching and grasping device.

A drawback of the method and device in accordance with Finnish Patent No. 69,439 is that the innermost layers formed on the paper core are unsuitable for printing, for which reason the roll cannot be unwound completely to the end. This causes a loss of material. Moreover, this prior art method and device require relatively complicated equipment, because the web is passed through the winder in doubled over fashion.

SUMMARY OF THE INVENTION

The invention may be used to provide an improvement of the methods known in prior art and, above all, an improvement of the method and device of Finnish Patent No. 69,439. In particular, the invention may be used to provide a method wherein the threading of the end of the web can be made faster while, at the same time, the number of components in the equipment needed for the threading is reduced.

In a method embodying the invention, a web is transferred by means of a fetching and grasping device to a web holding device, the web is held by means of the web holding device, the web is detached from the fetching and grasping device, the web is attached to a threading member carried by a carrier device, the web is detached from the web holding device, and the web is threaded as a single thickness through the winder.

A device embodying the invention includes a web holding device that is fitted so as to receive the web transferred by a fetching and grasping device and to hold the web, and a threading member carried by a carrier device. The threading member threads the web as a single thickness through the winder.

The method and the device in accordance with the invention may be used to achieve a number of advantages. The end of the web does not have to be torn to wedge-shaped form, and the threading of the web at full width makes the threading considerably faster. Also, the method and the device of the invention make the threading of the web faster because the time-consuming tearing off of the wedge-shaped end of the web is avoided. Likewise, the auxiliary equipment for threading, such as air blowers and belts, can be omitted. The method and the device of the invention permit relatively rapid threading of the web by one worker alone. The method and the device of the invention also produce economies of material, because no paper broke is formed.

The method and the device of the invention are applicable to machines in which the time taken to thread the web is long and which require a great deal of labor, such as coating machines, calenders, and slitter-winders.

BRIEF DESCRIPTION OF THE DRAWINGS

The invention will be described by way of example with reference to some preferred embodiments of the invention illustrated in the accompanying drawings, in which.

DETAILED DESCRIPTION

Figure 1:
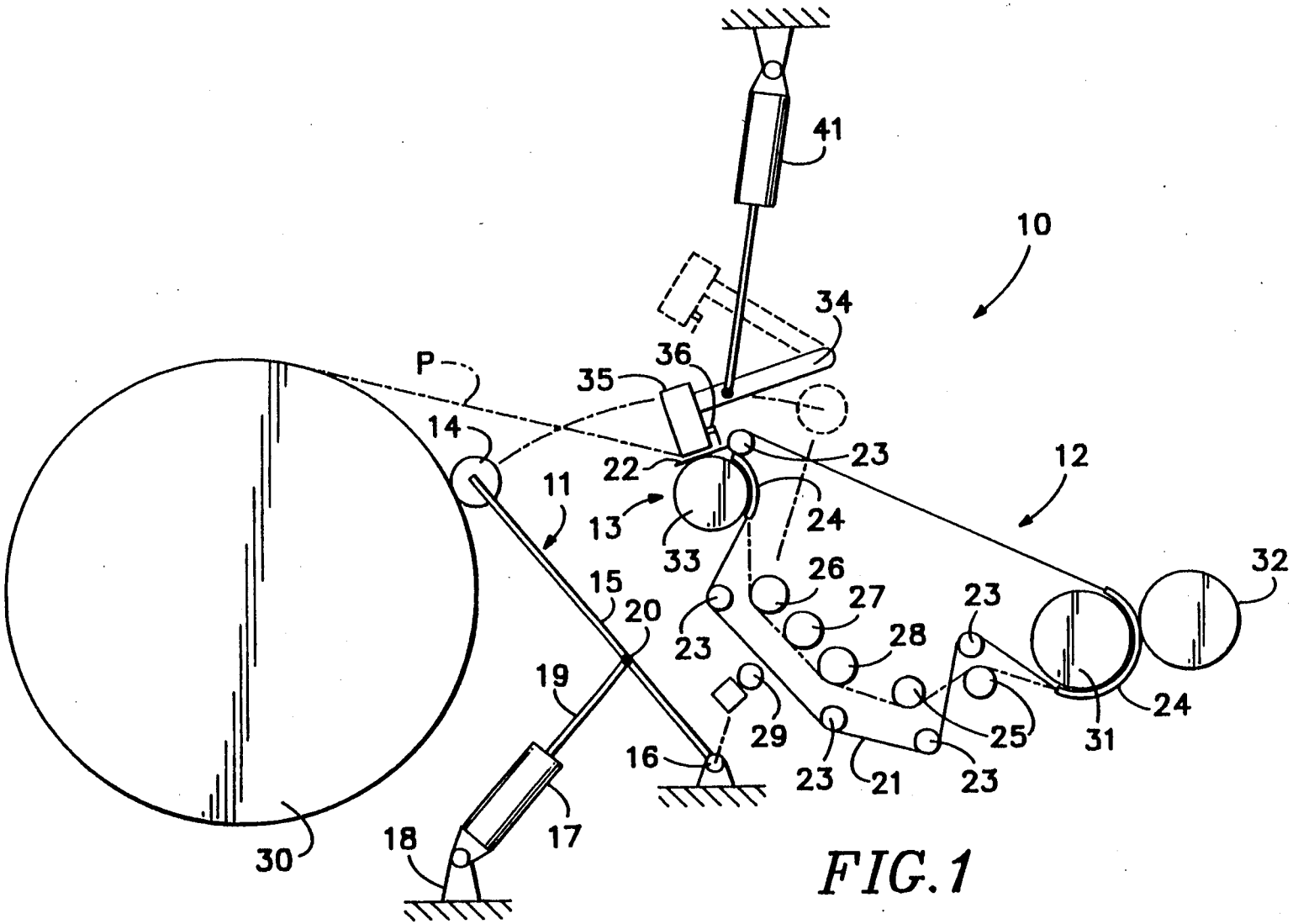
FIG. 1 is a side view of an advantageous embodiment of a device intended for carrying out the method of the invention, wherein the end of the web has been fetched from the jumbo roll by means of the fetching and grasping device.
Figure 2:
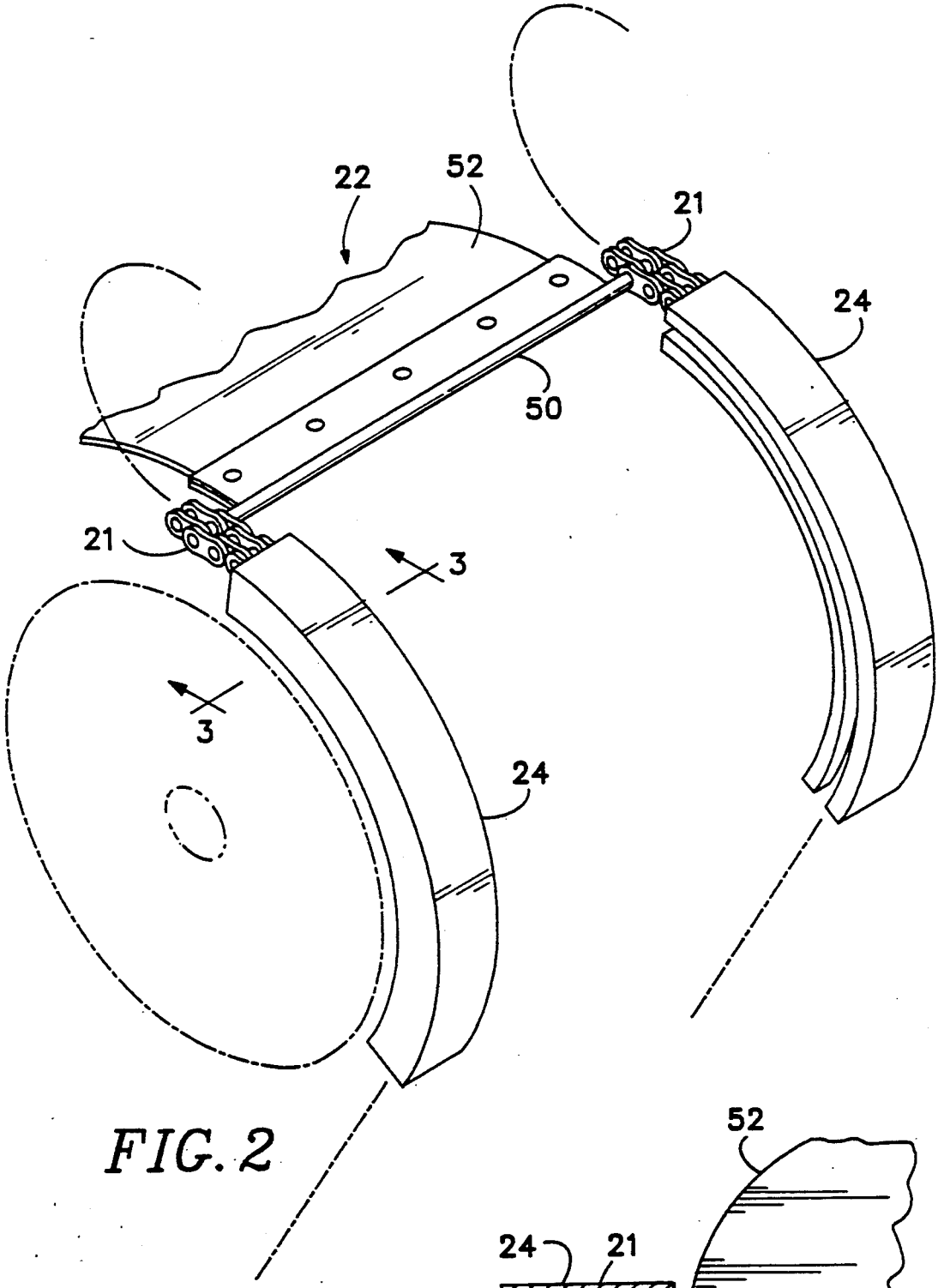
FIG. 2 is an enlarged perspective view, partly broken away, showing a detail of FIG. 1.

In the embodiment shown in FIG. 1, the device in accordance with the invention is denoted generally with the reference numeral 10. In this embodiment, the device 10 includes a fetching and grasping device 11, a carrier device 12, and a web holding device 13. In the embodiment of FIG. 1, the method and the device of the invention are applied to a slitter-winder comprising a rear carrier roll 31 and a front carrier roll 32. The jumbo roll is denoted with the reference numeral 30, and the web unwound from the jumbo roll 30 with the letter P.

The fetching and grasping device 11 consists of a suction roll 14, an arm 15 being fitted to displace said roll 14 by means of a cylinder 17. The arm 15 is pivoted about an articulation point 16 by means of a cylinder 17 that is mounted to the frame of the slitter-winder by a fastening bracket 18 and has a piston 19 connected to arm 15 at an articulation point 20.

Figure 3:
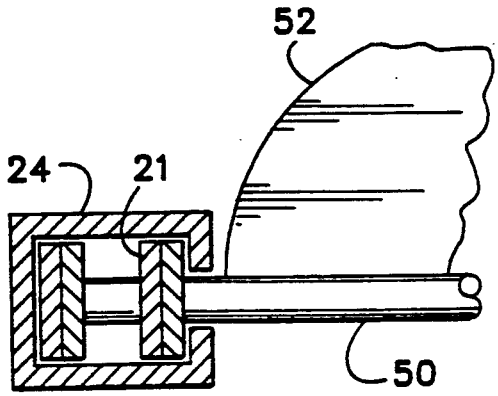
FIG. 3 is a sectional view taken on the line 3—3 of FIG. 2.

The carrier device 12 consists of two chains 21 at opposite respective sides of the apparatus. The chains are trained around guide rolls 23 and pass around the roll 33 of the web holding device 13 and around the carrier roll 31 through glide guides 24, one of which is shown in section in FIG. 3. A threading member 22 is fitted on the chains 21 and comprises a wire cable 50 that extends across the apparatus and is connected at its opposite ends to the two chains 21 respectively, and a flexible plate 52 attached to the wire cable. The carrier device also comprises a knife board 26–29 for slitting the web into component webs, and spreading members for spreading the strips. The knife board consists of rolls 26 and 28, a lower knife 27 and an upper knife 29.

The web holding device 13 consists either of a suction roll 33 alone, or alternatively of an ordinary (non-suction) roll 33 and a beam 35 fitted above said roll 33 at the opposite side of the web P and attached to an arm 34 that is pivotable under control of a cylinder 41. In the embodiment of FIG. 1, the beam 35 is provided with a cutter blade 36. The web P may, of course, also be cut off manually or by some other means.

The device shown in FIG. 1 operates as follows. The web P is fetched from the jumbo roll 30 by means of the suction roll 14 and is transferred to the web holding device 13, in other words, in the present embodiment, onto the suction roll 33. Next, the web P is attached to the holding device 13, in this embodiment by switching on the suction to the suction roll 33. The web P is then detached from the fetching and grasping device 11, in this embodiment from the suction roll 14. The detaching takes place simply by cutting off the end of the web P by means of the cutter blade 36, whereby the web P is released from the grip of the suction roll 14. Then the end of the web P is attached to the threading member 22. This may be accomplished by use of a strip of two-sided adhesive tape attached to the flexible plate 52, whereby the end of the web P adheres to the flexible plate 52. Next, the web P is detached from the web holding device 13 by switching off the suction to the suction roll 33. Finally the web P attached to the threading member 22 is passed as a single thickness through the slitter-winder, being carried by the carrier device 12, whereby web P is unwound from the jumbo roll 30 during the threading.

Figure 4:
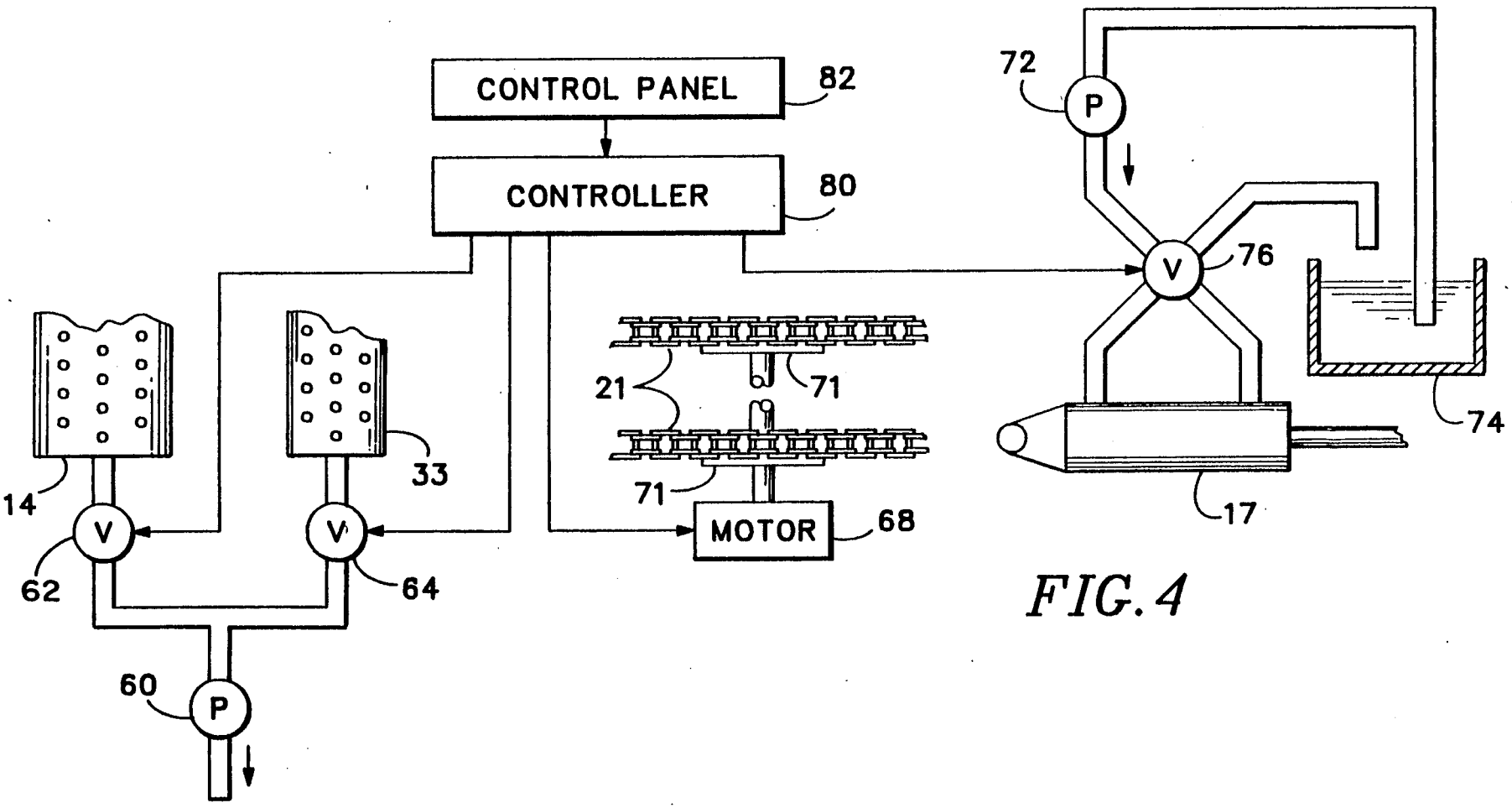
FIG. 4 illustrates schematically apparatus for controlling operation of the device shown in FIG. 1.

FIG. 4 illustrates schematically apparatus for controlling operation of the embodiment shown in FIG. 1. FIG. 4 illustrates a vacuum pump 60 which is selectively connectable through valves 62 and 64 to suction rolls 14 and 33. An electric motor 68 has an output shaft coupled to drive sprockets 71 in driving engagement with chains 21. A hydraulic pump 72, which draws hydraulic fluid from a sump 74, is selectively connectable by a valve 76 to cylinder 17. A programmed controller 80 controls operation of valves 62 and 64, motor 68 and valve 76, in response to instructions received from a control panel 82, to operate the apparatus shown in FIG. 1 in the manner described above.

In an alternative manner of operating the apparatus in accordance with FIG. 1, the procedure is substantially similar to that described above, but the web P is held by means of pressing produced by an ordinary (non-suction) roll 33 and a beam 35. Thus, in this alternative embodiment, suction is required in the suction roll 14 alone.

Figure 5:
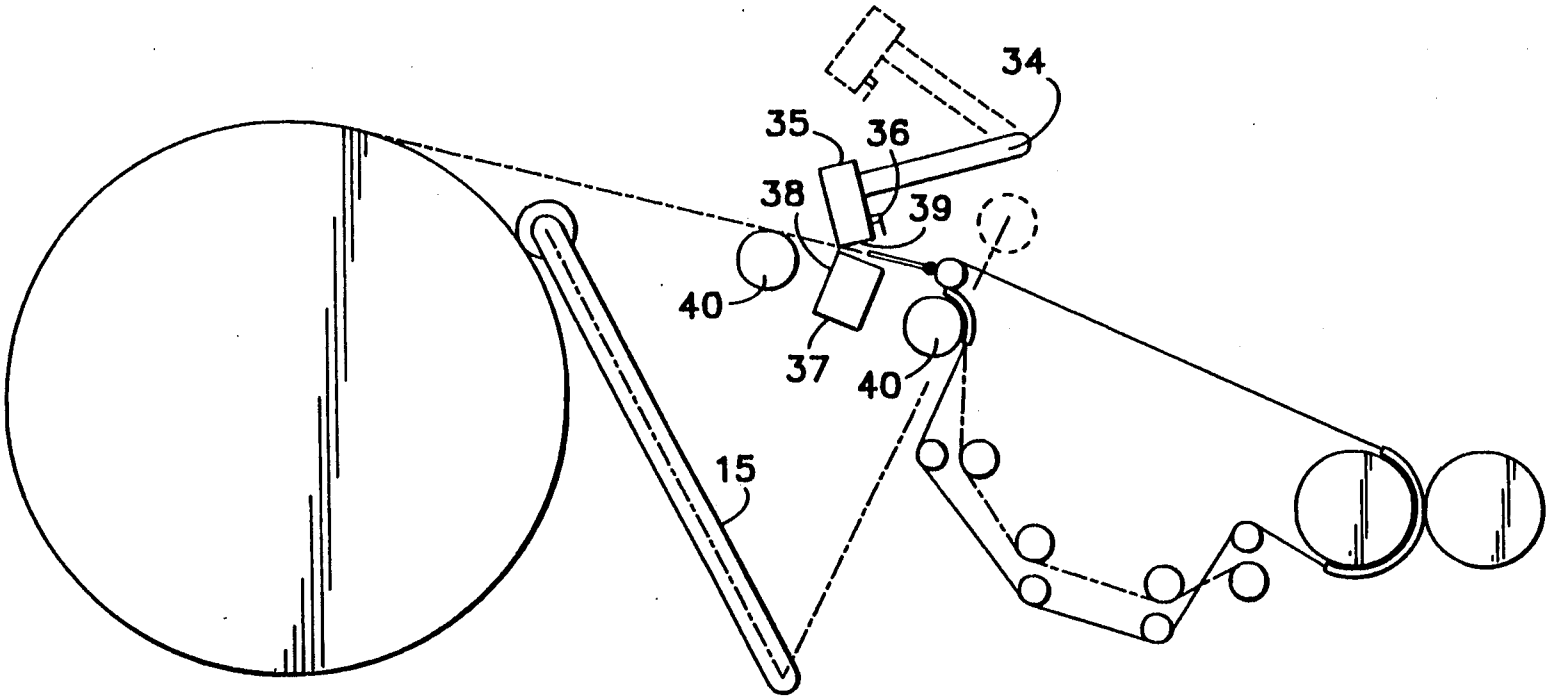
FIG. 5 is a side view of a second advantageous embodiment of a device intended for carrying out the method of the invention, wherein the end of the web has been fetched from the jumbo roll by means of the fetching and grasping device.

In the embodiment of FIG. 5 the web holding device 13 consists of a beam 37 provided with a suction plane 38. If desired, above the beam 37, at the opposite side of the web P, it is possible to provide a beam 35 which is attached to a pivotally mounted arm 34 and may, in this embodiment, be provided with a suction plane 39. The suction plane 39 is, however, not essential. The reference numeral 40 refers to web alignment rolls. In other respects, the procedure for threading the web in the device in accordance with FIG. 5 corresponds to that in the embodiment of FIG. 1.

If desired, in the method of the present invention, it is possible to proceed partly in a manner corresponding to the method of Finnish Patent No. 69,439, i.e. it is possible to wind a desired number of windings around the suction roll 14 of the fetching and grasping device 11. This winding-around is, however, not necessary, whereas it is necessary in the method of Finnish Patent No. 69,439.

Above, only some advantageous embodiments of the invention are described, and it is evident that numerous modifications can be made to them within the scope of the inventive idea defined in the accompanying claims. For example, it is not necessary to employ double-sided adhesive tape to attach the web to the flexible plate 52, since glue may be used instead.

I claim:

1. Apparatus for threading the end of a web from a jumbo roll or the like along a selected path through a web processing arrangement, comprising:

a web holding device operative selectively to hold the web or release the web, the web holding device comprising first and second press members for gripping the web therebetween and the first press member being a suction roll, a fetching and grasping device for grasping the end of the web on the jumbo roll, transfer means for causing the fetching and grasping device to transfer the end of the web to a position such that the web extends adjacent the web holding device, so that the web holding device may be operated to hold the web, a threading member, means for advancing the threading member along the selected path, and means for attaching the threading member to the web when it is held by the web holding device, so that when the web holding device is operated to release the web and the threading member is advanced, the web is threaded through the web processing arrangement as a single thickness and the web is unwound from the jumbo roll.

2. Apparatus according to claim 1, wherein the fetching and grasping device comprises an arm that is pivotally mounted with respect to the jumbo roll, and a suction roll supported by the arm, and the transfer means comprise an actuator member that acts on the arm to move the suction roll along a predetermined path of movement towards and away from the jumbo roll.

3. Apparatus according to claim 1, wherein the first press member is stationary with respect to translation relative to the jumbo roll, and the apparatus comprises an arm that is pivotable relative to the first press member, and the second press member is attached to the arm for pivotal movement relative to the first press member.

4. Apparatus according claim 1, wherein the second press member is a beam.

5. Apparatus according to claim 1, further comprising a cutter blade attached to the second press member.

6. Apparatus according to claim 5, wherein the cutter blade is attached to said second press member for cutting the web at a position on the opposite side of the web holding device from the jumbo roll.

7. Apparatus according to claim 1, comprising an arm that is pivotable relative to the first press member, and wherein the second press member is attached to the arm for pivotal movement relative to the first press member.

8. Apparatus for threading the end of a web from a jumbo roll or the like along a selected path through a web processing arrangement, comprising:

a web holding device operative selectively to hold the web or release the web, the web holding device comprising first and second press members for gripping the web therebetween and the first press member being a roll, a fetching and grasping device for grasping the end of the web on the jumbo roll, transfer means for causing the fetching and grasping device to transfer the end of the web to a position such that the web extends adjacent the web holding device, so that the web holding device may be operated to hold the web, a threading member, means for advancing the threading member along the selected path, and means for attaching the threading member to the web when it is held by the web holding device, so that when the web holding device is operated to release the web and the threading member is advanced, the web is threaded through the web processing arrangement as a single thickness and the web is unwound from the jumbo roll.

9. Apparatus according to claim 8, wherein the fetching and grasping device comprises an arm that is pivotally mounted with respect to the jumbo roll, and a suction roll supported by the arm, and the transfer means comprise an actuator member that acts on the arm to move the suction roll along a predetermined path of movement towards and away from the jumbo roll.

10. Apparatus according to claim 8, wherein the first press member is stationary with respect to translation relative to the jumbo roll, and the apparatus comprises an arm that is pivotable relative to the first press member, and the second member is attached to the arm for pivotal movement relative to the first press member.

11. Apparatus according to claim 8, wherein the second press member is a beam.

12. Apparatus according to claim 11, further comprising a cutter blade attached to the beam.

13. Apparatus according to claim 12, wherein the cutter blade is attached to said beam for cutting the web at a position on the opposite side of the web holding device from the jumbo roll.

14. Apparatus according to claim 8, comprising an arm that is pivotable relative to the first press member, and wherein the second press member is attached to the arm for pivotal movement relative to the first press member.

15. Apparatus for threading the end of a web from a jumbo roll or the like along a selected path through a web processing arrangement, comprising:

a web holding device operative selectively to hold the web or release the web, the web holding device comprising first and second press members for gripping the web therebetween, a cutter blade attached to one of the press members, a fetching and grasping device for grasping the end of the web on the jumbo roll, transfer means for causing the fetching and grasping device to transfer the end of the web to a position such that the web extends adjacent the web holding device, so that the web holding device may be operated to hold the web, a threading member, means for advancing the threading member along the selected path, and means for attaching the threading member to the web when it is held by the web holding device, so that when the web holding device is operated to release the web and the threading member is advanced, the web is threaded through the web processing arrangement as a single thickness and the web is unwound from the jumbo roll.

16. Apparatus according to claim 15, wherein the fetching and grasping device comprises an arm that is pivotally mounted with respect to the jumbo roll, and a suction roll supported by the arm, and the transfer means comprise an actuator member that acts on the arm to move the suction roll along a predetermined path of movement towards and away from the jumbo roll.

17. Apparatus according to claim 15, wherein the first press member is stationary with respect to translation relative to the jumbo roll, and the apparatus comprises an arm that is pivotable relative to the first press member, and the second press member is attached to the arm for pivotal movement relative to the first press member.

18. Apparatus according to claim 15, wherein the first and second press members comprise respective beams.

19. Apparatus according to claim 18, wherein the first press member has a suction plane and the cutter blade is attached to the second press member.

20. Apparatus according to claim 18, comprising an arm that is pivotable relative to the first press member, and wherein the second press member is attached to the arm for pivotal movement relative to the first press member.

21. Apparatus according to claim 15, wherein the cutter blade is attached to said one press member for cutting the web at a position on the opposite side of the web holding device from the jumbo roll.

* * * * *